US011673773B2

(12) United States Patent
Billard et al.

(10) Patent No.: US 11,673,773 B2
(45) Date of Patent: Jun. 13, 2023

(54) ROPELESS ELEVATOR PROPULSION SYSTEM

(71) Applicant: Otis Elevator Company, Farmington, CT (US)

(72) Inventors: Justin Billard, Amston, CT (US); Randy Roberts, Hebron, CT (US); Kiron Bhaskar, Farmington, CT (US); Kyle B. Martin, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 41 days.

(21) Appl. No.: 17/092,233

(22) Filed: Nov. 7, 2020

(65) Prior Publication Data

US 2022/0144590 A1 May 12, 2022

(51) Int. Cl.

| | |
|---|---|
| ***B66B 9/02*** | (2006.01) |
| ***B66B 11/00*** | (2006.01) |
| ***B66B 11/04*** | (2006.01) |

(52) U.S. Cl.

CPC ..... *B66B 9/02* (2013.01); *B66B 11/005* (2013.01); *B66B 11/043* (2013.01)

(58) Field of Classification Search

CPC ..... B66B 11/005; B66B 11/043; B66B 9/02; B66B 9/022

See application file for complete search history.

(56) References Cited

U.S. PATENT DOCUMENTS 3,381,541 A * 5/1968 Thireau ..... F16C 32/06 187/250
5,713,432 A * 2/1998 Richter ..... B66B 11/0206 187/250
8,235,178 B2 * 8/2012 Kocher ..... B66B 9/02 187/250
11,407,617 B2 * 8/2022 Bhaskar ..... B66B 7/022
2005/0179019 A1 * 8/2005 Ellingson ..... B66B 9/02 254/265

FOREIGN PATENT DOCUMENTS

| | | | | |
|---|---|---|---|---|
| EP | 1364904 A1 * | 11/2003 | ..... | B66B 9/02 |
| EP | 3453664 A1 | 3/2019 | | |
| WO | WO-2008136692 A2 * | 11/2008 | ..... | B66B 11/0407 |
| WO | WO-2017017119 A1 * | 2/2017 | | |
| WO | WO-2021144418 A1 * | 7/2021 | | |

OTHER PUBLICATIONS

Search Report for European Application No. 21206958.7 dated Apr. 20, 2022.

* cited by examiner

*Primary Examiner* — Diem M Tran

(74) *Attorney, Agent, or Firm* — Cantor Colburn LLP

(57) ABSTRACT

According to an embodiment, an elevator system including: a beam climber system configured to move an elevator car through an elevator shaft by climbing a first guide beam that extends vertically through the elevator shaft, the first guide beam including a first surface and a second surface opposite the first surface, the beam climber system including: a first wheel; a second wheel; a first traction belt wrapped around the first wheel and the second wheel, the first traction belt being in contact with the first surface; and a first electric motor configured to rotate the first wheel, wherein the first traction belt is configured to rotate when the first wheel rotates.

19 Claims, 5 Drawing Sheets

ROPELESS ELEVATOR PROPULSION SYSTEM

BACKGROUND

The subject matter disclosed herein relates generally to the field of ropeless elevator systems, and specifically to a method and apparatus for propelling a ropeless elevator system.

Elevator cars are conventionally operated by ropes and counterweights, which typically only allow one elevator car in an elevator shaft at a single time. Ropeless elevator systems may allow for more than one elevator car in the elevator shaft at a single time.

BRIEF SUMMARY

According to an embodiment, an elevator system is provided. The elevator system including: a beam climber system configured to move an elevator car through an elevator shaft by climbing a first guide beam that extends vertically through the elevator shaft, the first guide beam including a first surface and a second surface opposite the first surface, the beam climber system including: a first wheel; a second wheel; a first traction belt wrapped around the first wheel and the second wheel, the first traction belt being in contact with the first surface; and a first electric motor configured to rotate the first wheel, wherein the first traction belt is configured to rotate when the first wheel rotates.

In addition to one or more of the features described herein, or as an alternative, further embodiments may include that the first traction belt is magnetically attracted to the first guide beam.

In addition to one or more of the features described herein, or as an alternative, further embodiments may include that the first traction belt is configured to climb up or down the first guide beam when rotated.

In addition to one or more of the features described herein, or as an alternative, further embodiments may include that the beam climber system further includes: a third wheel in contact with the second surface.

In addition to one or more of the features described herein, or as an alternative, further embodiments may include that the third wheel is located opposite the first wheel.

In addition to one or more of the features described herein, or as an alternative, further embodiments may include that the first traction belt is composed of a flexible magnetic sheet.

In addition to one or more of the features described herein, or as an alternative, further embodiments may include that the first traction belt is composed of a backing belt and coated magnets.

In addition to one or more of the features described herein, or as an alternative, further embodiments may include that the first traction belt is magnetized.

In addition to one or more of the features described herein, or as an alternative, further embodiments may include a second guide beam that extends vertically through the elevator shaft, the second guide beam including a first surface of the second guide beam and a second surface of the second guide beam opposite the first surface of the second guide beam, wherein the beam climber system further includes: a third wheel; a fourth wheel; a second traction belt wrapped around the third wheel and the fourth wheel, the second traction belt being in contact with the first surface of the second guide beam and being magnetically attracted to the second guide beam; a second electric motor configured to rotate the third wheel, wherein the second traction belt is configured to rotate when the third wheel rotates.

In addition to one or more of the features described herein, or as an alternative, further embodiments may include that the second traction belt is configured to climb up or down the second guide beam when rotated.

According to another embodiment, an elevator system is provided. The elevator system including: a beam climber system configured to move an elevator car through an elevator shaft by climbing a first guide beam that extends vertically through the elevator shaft, the first guide beam including a first surface and a second surface opposite the first surface, the beam climber system including: a first wheel; a second wheel; a first motor configured to rotate the first wheel; a first traction belt wrapped around the first wheel, the second wheel, and the first motor, the first traction belt being in contact with the first surface, wherein the first traction belt, the first wheel, and the second wheel are configured to rotate when the first motor rotates.

In addition to one or more of the features described herein, or as an alternative, further embodiments may include that the first traction belt is configured to climb up or down the first guide beam when rotated.

In addition to one or more of the features described herein, or as an alternative, further embodiments may include that the first traction belt is a toothed timing belt.

In addition to one or more of the features described herein, or as an alternative, further embodiments may include that the first traction belt is a traditional flat belt.

In addition to one or more of the features described herein, or as an alternative, further embodiments may include that the beam climber system further includes a structural support frame, the structural support frame including a first vertical component, a second vertical component, and a horizontal component connecting the first vertical component and the second vertical component.

In addition to one or more of the features described herein, or as an alternative, further embodiments may include that the beam climber system further includes a first pivot arm, wherein the first wheel is operably attached to the first vertical component through the first pivot arm.

In addition to one or more of the features described herein, or as an alternative, further embodiments may include that the beam climber system further includes a second pivot arm, wherein the second wheel is operably attached to the first vertical component through the second pivot arm.

In addition to one or more of the features described herein, or as an alternative, further embodiments may include that the beam climber system further includes a third pivot arm, wherein the first wheel and the second wheel are operably connected to the third pivot arm.

In addition to one or more of the features described herein, or as an alternative, further embodiments may include that the beam climber system further includes a first spring extending between the first pivot arm to the horizontal component.

In addition to one or more of the features described herein, or as an alternative, further embodiments may include that the beam climber system further including a first biasing assembly operably attached to the third pivot arm, the first biasing assembly configured to press the first roller wheel against the first traction belt, which is pressed against the first surface of the first guide beam.

Technical effects of embodiments of the present disclosure include compressing a tread against a beam using magnetism or pressure for the elevator to climb through an elevator shaft.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
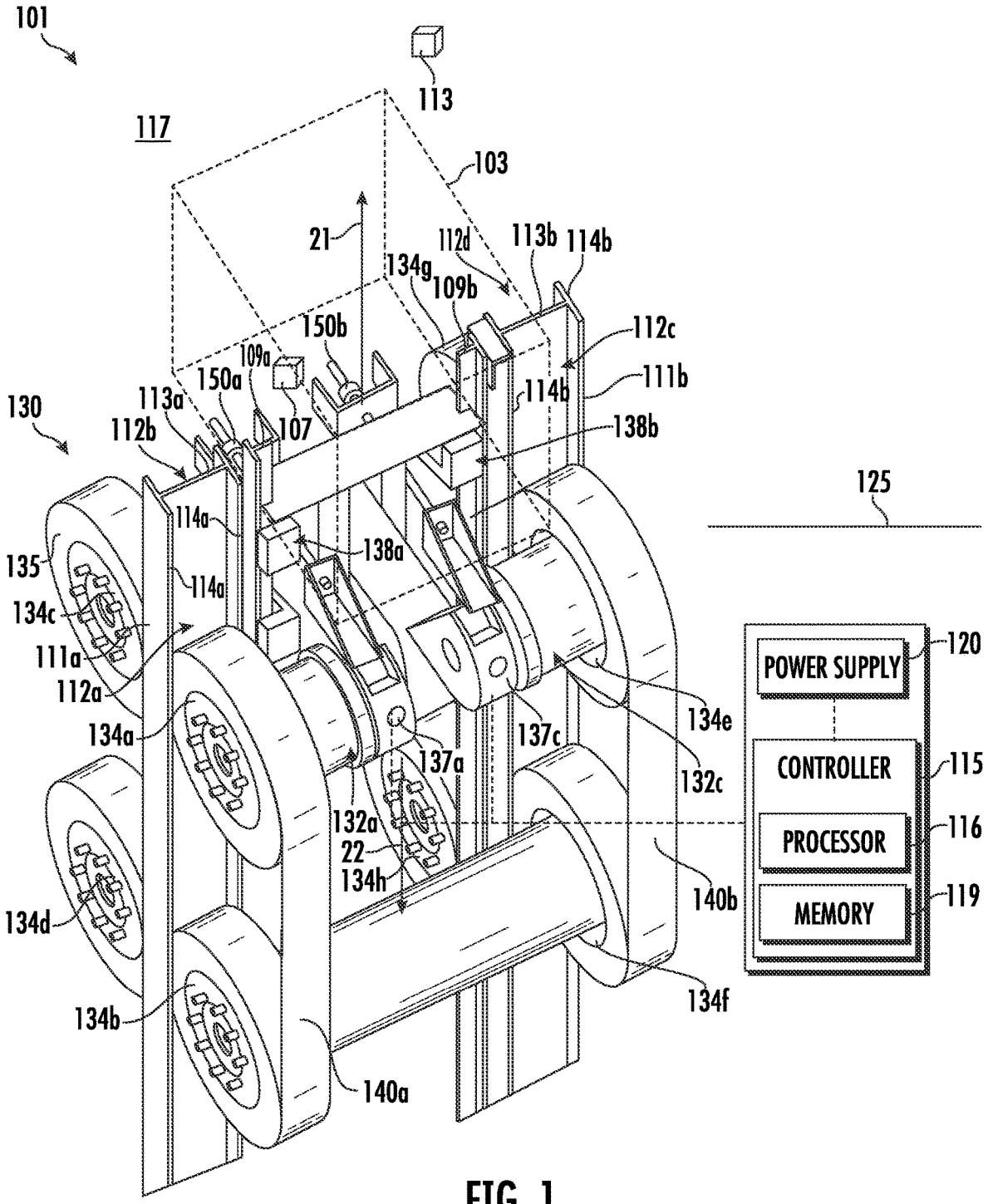
FIG. 1 is a schematic illustration of an elevator system with a beam climber system, in accordance with an embodiment of the disclosure.

Referring now to FIGS. 1-4, FIG. 1 is a perspective view of an elevator system 101 including an elevator car 103, a beam climber system 130, a controller 115, and a power supply 120. Although illustrated in FIG. 1 as separate from the beam climber system 130, the embodiments described herein may be applicable to a controller 115 included in the beam climber system 130 (i.e., moving through an elevator shaft 117 with the beam climber system 130) and may also be applicable to a controller located off of the beam climber system 130 (i.e., remotely connected to the beam climber system 130 and stationary relative to the beam climber system 130). Although illustrated in FIG. 1 as separate from the beam climber system 130, the embodiments described herein may be applicable to a power supply 120 included in the beam climber system 130 (i.e., moving through the elevator shaft 117 with the beam climber system 130) and may also be applicable to a power supply located off of the beam climber system 130 (i.e., remotely connected to the beam climber system 130 and stationary relative to the beam climber system 130).

The beam climber system 130 is configured to move the elevator car 103 within the elevator shaft 117 and along guide rails 109*a*, 109*b* that extend vertically through the elevator shaft 117. In an embodiment, the guide rails 109*a*, 109*b* are T-beams. The beam climber system 130 includes one or more electric motors 132*a*, 132*c*. The electric motors 132*a*, 132*c* are configured to move the beam climber system 130 within the elevator shaft 117 by rotating one or more wheels 134*a*, 134*e*, which rotate traction belts 140*a*, 140*b* that are pressed against a guide beam 111*a*, 111*b*. In an embodiment, the guide beams 111*a*, 111*b* are I-beams. It is understood that while an I-beam is illustrated, any beam or similar structure may be utilized with the embodiment described herein.

Figure 2:
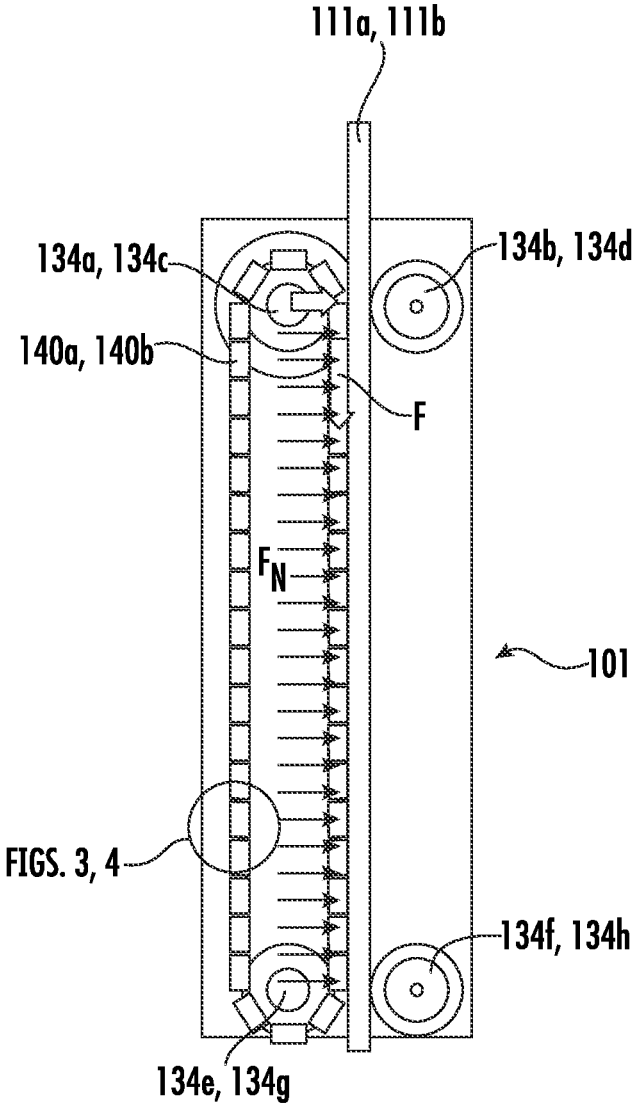
FIG. 2 illustrates a side view of the beam climber system of FIG. 1, in accordance with an embodiment of the disclosure.
Figure 3:
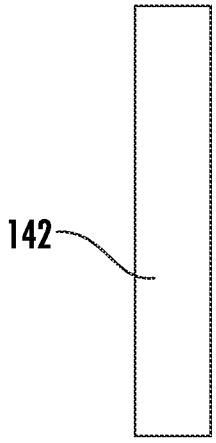
FIG. 3 illustrates an enlarge view of a magnetic tread of FIG. 2, in accordance with an embodiment of the disclosure.
Figure 4:
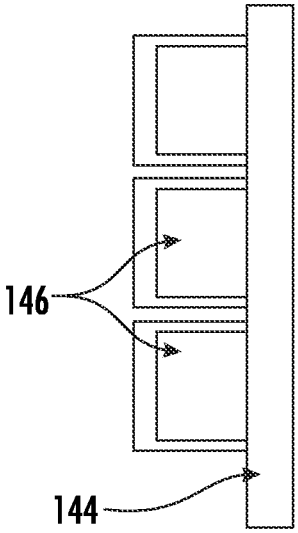
FIG. 4 illustrates an enlarge view of a magnetic tread of FIG. 2, in accordance with an embodiment of the disclosure.

The traction belts 140*a*, 140*b* may be configured to magnetically attract to the guide beams 111*a*, 111*b*. The traction belts 140*a*, 140*b* may be magnetized and/or the guide beams 111*a*, 111*b* may be magnetized. Magnetic attraction between the guide beams 111*a*, 111*b* and the traction belts 140*a*, 140*b* driven by the electric motors 132*a*, 132*c* allows the beam climber system 130 to climb up 21 and down 22 the guide beams 111*a*, 111*b*. The magnetic attraction creates a large normal force $F_N$ pushing the traction belt 140*a*, 140*b* against the guide beams 111*a*, 111*b*, as shown in FIG. 2. Then rotation of the motorized wheels 134*a*, 134*c* create a force F parallel to the guide beams 111*a*, 111*b*, which allows the traction belt 140*a*, 140*b* to climb up 21 or down 22 the guide beam 111*a*, 111*b*, as shown in FIG. 2. In an embodiment, the traction belt 140*a*, 140*b* may be composed of a flexible magnetic sheet 142 as illustrated in FIG. 3. In another embodiment, the traction belt 140*a*, 140*b* may be composed of a backing belt 144 and coated magnets 146 as illustrated in FIG. 4.

The guide beam extends vertically through the elevator shaft 117. It is understood that while two guide beams 111*a*, 111*b* are illustrated, the embodiments disclosed herein may be utilized with one or more guide beams. It is also understood that while two electric motors 132*a*, 132*c* are visible, the embodiments disclosed herein may be applicable to beam climber systems 130 having one or more electric motors. For example, the beam climber system 130 may have one electric motor for each wheel 134*a*, 134*b*, 134*c*, 134*d*, 134*e*, 134*f*, 134*g*, 134*h*. The electrical motors 132*a*, 132*c* may be permanent magnet electrical motors, asynchronous motor, or any electrical motor known to one of skill in the art.

The beam climber system 130 may include eight wheels 134*a*, 134*b*, 134*c*, 134*d*, 134*e*, 134*f*, 134*g*, 134*h*, which includes a first wheel 134*a*, a third wheel 134*c*, a fifth wheel 134*e*, a seventh wheel 134*g*, a second wheel 134*b*, a fourth wheel 134*d*, a sixth wheel 134*f*, and an eighth wheel 134*h*. As illustrated in FIG. 1, the first traction belt 140*a* may extend between and wrap around the first wheel 134*a* and the second wheel 134*b*. The first traction belt 140*a* rotates around the first wheel 134*a* and the second wheel 134*b*. The rotation of the first wheel 134*a* causes the first traction belt 140*a* to rotate, which causes the second wheel 134*b* to rotate. As illustrated in FIG. 1, the second traction belt 140*b* may extend between and wrap around the fifth wheel 134*e* and the sixth wheel 134*f*. The second traction belt 140*b* rotates around the fifth wheel 134*e* and the sixth wheel 134*f* The rotation of the fifth wheel 134*e* causes the second traction belt 140*b* to rotate, which causes the sixth wheel 134*f* to rotate.

The third wheel 134*c*, seventh wheel 134*g*, fourth wheel 134*d*, and eighth wheel 134*h* may act as idler wheels and be free to rotate with the movement of the other wheels 134*a*, 134*b*, 134*e*, 134*f*.

The third wheel 134*c* may be located opposite the first wheel 134, the fourth wheel 134*d* may be located opposite the second wheel 134*b*, the seventh wheel 134*g* may be located opposite the fifth wheel 134*e*, and the eighth wheel 134*h* may be located opposite the sixth wheel 134*f*.

The first guide beam 111*a* includes a web portion 113*a* and two flange portions 114*a*. The web portion 113*a* of the first guide beam 111*a* includes a first surface 112*a* and a second surface 112*b* opposite the first surface 112*a*. The first wheel 134*a* and the second wheel 134*b* are in contact with the first surface 112*a* through the first traction belt 140*a* and a third wheel 134*c* and the fourth wheel 134*d* may each be in contact with the second surface 112*b* through tires 135. The first wheel 134*a* and the second wheel 134*b* are compressed against the first surface 112*a* of the first guide beam 111*a* by a first compression mechanism 150*a* and the third wheel 134*c* and the fourth wheel 134*d* are compressed against the second surface 112*b* of the first guide beam 111*a* by the first compression mechanism 150*a*. The first compression mechanism 150*a* compresses the first wheel 134*a* and the third wheel 134*c* together to clamp onto the web portion 113*a* of the first guide beam 111*a*. The first compression mechanism 150*a* may be a metallic or elastomeric spring mechanism, a pneumatic mechanism, a hydraulic mechanism, a turnbuckle mechanism, an electromechanical actuator mechanism, a spring system, a hydraulic cylinder, a motorized spring setup, or any other known force actuation method. The first compression mechanism 150*a* may be adjustable in real-time during operation of the elevator system 101 to control compression of the first wheel 134*a* and the third wheel 134*c* on the first guide beam 111*a*. The third wheel 134*c* and the fourth wheel 134*d* may each include a tire 135 to increase traction with the first guide beam 111*a*.

The first surface 112*a* and the second surface 112*b* extend vertically through the shaft 117, thus creating a track for the first traction belt 140*a*, the third wheel 134*c*, and the fourth wheel 134*d* to ride on. The flange portions 114*a* may work as guardrails to help guide the first traction belt 140*a*, the third wheel 134*c*, and the fourth wheel 134*d* along this track and thus help prevent the first traction belt 140*a*, the third wheel 134*c*, and the fourth wheel 134*d* from running off track.

The first electric motor 132*a* is configured to rotate the first wheel 134*a*, which rotates the first traction belt 140*a* to climb up 21 or down 22 the first guide beam 111*a*. The first electric motor 132*a* may also include a first motor brake 137*a* to slow and stop rotation of the first electric motor 132*a*. The first motor brake 137*a* may be mechanically connected to the first electric motor 132*a*. The first motor brake 137*a* may be a clutch system, a disc brake system, a drum brake system, a brake on a rotor of the first electric motor 132*a*, an electronic braking, an Eddy current brakes, a Magnetorheological fluid brake or any other known braking system. The beam climber system 130 may also include a first guide rail brake 138*a* operably connected to the first guide rail 109*a*. The first guide rail brake 138*a* is configured to slow movement of the beam climber system 130 by clamping onto the first guide rail 109*a*. The first guide rail brake 138*a* may be a caliper brake acting on the first guide rail 109*a* on the beam climber system 130, or caliper brakes acting on the first guide rail 109*a* proximate the elevator car 103.

The second guide beam 111*b* includes a web portion 113*b* and two flange portions 114*b*. The web portion 113*b* of the second guide beam 111*b* includes a first surface 112*c* and a second surface 112*d* opposite the first surface 112*c*. A fifth wheel 134*e* and a sixth wheel 134*f* are in contact with the first surface 112*c* through the second traction belt 140*b* and a seventh wheel 134*g* and eighth wheel 134*h* may each be in contact with the second surface 112*d* through tires 135. A fifth wheel 134*e* is compressed against the first surface 112*c* of the second guide beam 111*b* by a second compression mechanism 150*b* and a seventh wheel 134*g* is compressed against the second surface 112*d* of the second guide beam 111*b* by the second compression mechanism 150*b*. The second compression mechanism 150*b* compresses the fifth wheel 134*e* and the seventh wheel 134*g* together to clamp onto the web portion 113*b* of the second guide beam 111*b*. The second compression mechanism 150*b* may be a spring mechanism, turnbuckle mechanism, an actuator mechanism, a spring system, a hydraulic cylinder, and/or a motorized spring setup. The second compression mechanism 150*b* may be adjustable in real-time during operation of the elevator system 101 to control compression of the fifth wheel 134*e* and the seventh wheel 134*g* on the second guide beam 111*b*. The seventh wheel 134*g* and the eighth wheel 134*h* may each include a tire 135 to increase traction with the second guide beam 111*b*.

The first surface 112*c* and the second surface 112*d* extend vertically through the shaft 117, thus creating a track for the second traction belt 140*b*, the seventh wheel 134*g*, and the eighth wheel 140*h* to ride on. The flange portions 114*b* may work as guardrails to help guide the second traction belt 140*b*, the seventh wheel 134*g*, and the eighth wheel 140*h* along this track and thus help prevent the second traction belt 140*b*, the seventh wheel 134*g*, and the eighth wheel 140*h* from running off track.

The second electric motor 132*c* is configured to rotate the fifth wheel 134*e*, which rotates the second traction belt 140*b* to climb up 21 or down 22 the second guide beam 111*b*. The second electric motor 132*c* may also include a third motor brake 137*c* to slow and stop rotation of the third motor 132*c*. The third motor brake 137*c* may be mechanically connected to the third motor 132*c*. The third motor brake 137*c* may be a clutch system, a disc brake system, drum brake system, a brake on a rotor of the second electric motor 132*c*, an electronic braking, an Eddy current brake, a Magnetorheological fluid brake, or any other known braking system. The beam climber system 130 includes a second guide rail brake 138*b* operably connected to the second guide rail 109*b*. The second guide rail brake 138*b* is configured to slow movement of the beam climber system 130 by clamping onto the second guide rail 109*b*. The second guide rail brake 138*b* may be a caliper brake acting on the first guide rail 109*a* on the beam climber system 130, or caliper brakes acting on the first guide rail 109*a* proximate the elevator car 103.

The elevator system 101 may also include a position reference system 113. The position reference system 113 may be mounted on a fixed part at the top of the elevator shaft 117, such as on a support or guide rail 109, and may be configured to provide position signals related to a position of the elevator car 103 within the elevator shaft 117. In other embodiments, the position reference system 113 may be directly mounted to a moving component of the elevator system (e.g., the elevator car 103 or the beam climber system 130), or may be located in other positions and/or configurations as known in the art. The position reference system 113 can be any device or mechanism for monitoring a position of an elevator car within the elevator shaft 117, as known in the art. For example, without limitation, the position reference system 113 can be an encoder, sensor, accelerometer, altimeter, pressure sensor, range finder, or other system and can include velocity sensing, absolute position sensing, etc., as will be appreciated by those of skill in the art.

The controller 115 may be an electronic controller including a processor 116 and an associated memory 119 comprising computer-executable instructions that, when executed by the processor 116, cause the processor 116 to perform various operations. The processor 116 may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 119 may be but is not limited to a random access memory (RAM), read only memory (ROM), or other electronic, optical, magnetic or any other computer readable medium.

The controller 115 is configured to control the operation of the elevator car 103 and the beam climber system 130. For example, the controller 115 may provide drive signals to the beam climber system 130 to control the acceleration, deceleration, leveling, stopping, etc. of the elevator car 103.

The controller 115 may also be configured to receive position signals from the position reference system 113 or any other desired position reference device.

When moving up 21 or down 22 within the elevator shaft 117 along the guide rails 109*a*, 109*b*, the elevator car 103 may stop at one or more landings 125 as controlled by the controller 115. In one embodiment, the controller 115 may be located remotely or in the cloud. In another embodiment, the controller 115 may be located on the beam climber system 130. In embodiment, the controller 115 controls on-board motion control of the beam climber system 130 (e.g., a supervisory function above the individual motor controllers).

The power supply 120 for the elevator system 101 may be any power supply, including a power grid and/or battery power which, in combination with other components, is supplied to the beam climber system 130. In one embodiment, power supply 120 may be located on the beam climber system 130. In an embodiment, the power supply 120 is a battery that is included in the beam climber system 130.

The elevator system 101 may also include an accelerometer 107 attached to the elevator car 103 or the beam climber system 130. The accelerometer 107 is configured to detect an acceleration and/or a speed of the elevator car 103 and the beam climber system 130.

Referring now to FIGS. 5-8, FIG. 5 is a perspective view of an elevator system 101 including an elevator car 103, a beam climber system 130, a controller 115, and a power supply 120. Although illustrated in FIG. 5 as separate from the beam climber system 130, the embodiments described herein may be applicable to a controller 115 included in the beam climber system 130 (i.e., moving through an elevator shaft 117 with the beam climber system 130) and may also be applicable to a controller located off of the beam climber system 130 (i.e., remotely connected to the beam climber system 130 and stationary relative to the beam climber system 130). Although illustrated in FIG. 5 as separate from the beam climber system 130, the embodiments described herein may be applicable to a power supply 120 included in the beam climber system 130 (i.e., moving through the elevator shaft 117 with the beam climber system 130) and may also be applicable to a power supply located off of the beam climber system 130 (i.e., remotely connected to the beam climber system 130 and stationary relative to the beam climber system 130).

The beam climber system 130 is configured to move the elevator car 103 within the elevator shaft 117 and along guide rails 109*a*, 109*b* that extend vertically through the elevator shaft 117. In an embodiment, the guide rails 109*a*, 109*b* are T-beams. The beam climber system 130 includes one or more electric motors 132*a*, 132*c*. The electric motors 132*a*, 132*c* are configured to move the beam climber system 130 within the elevator shaft 117 by rotating one or more wheels 134*a*, 134*e*, which rotate traction belts 140*a*, 140*b* that are pressed against a guide beam 111*a*, 111*b*. In an embodiment, the guide beams 111*a*, 111*b* are I-beams. It is understood that while an I-beam is illustrated, any beam or similar structure may be utilized with the embodiment described herein. The beam climber system 130 may include four tractions belts 140*a*, 140*b*, 140*c*, 140*d*.

Figure 6:
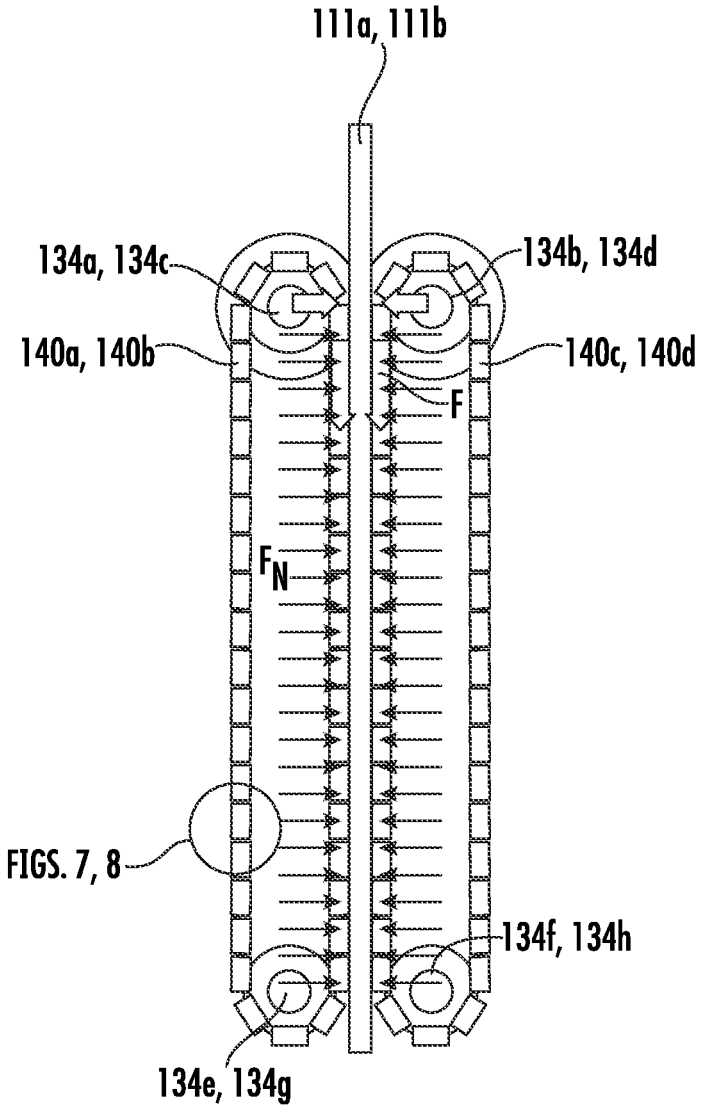
FIG. 6 illustrates a side view of the beam climber system of FIG. 5, in accordance with an embodiment of the disclosure.
Figure 7:
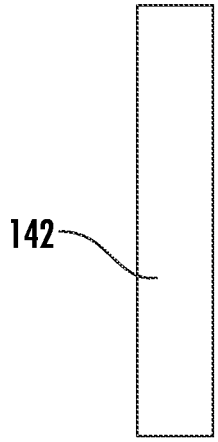
FIG. 7 illustrates an enlarge view of a magnetic tread of FIG. 6, in accordance with an embodiment of the disclosure.
Figure 8:
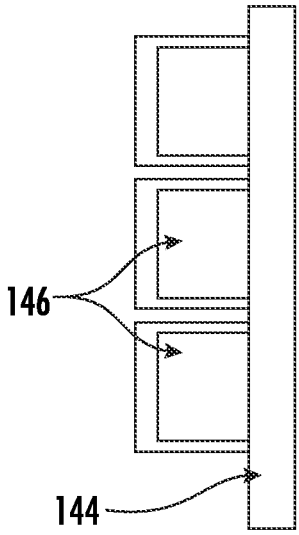
FIG. 8 illustrates an enlarge view of a magnetic tread of FIG. 6, in accordance with an embodiment of the disclosure.

The traction belts 140*a*, 140*b*, 140*c*, 140*d* may be configured to magnetically attract to the guide beams 111*a*, 111*b*. The traction belts 140*a*, 140*b*, 140*c*, 140*d* may be magnetized and/or the guide beams 111*a*, 111*b* may be magnetized. Magnetic attraction between the guide beams 111*a*, 111*b* and the traction belts 140*a*, 140*b*, 140*c*, 140*d* driven by the electric motors 132*a*, 132*c* allows the beam climber system 130 to climb up 21 and down 22 the guide beams 111*a*, 111*b*. The magnetic attraction creates a large normal force $F_N$ pushing the traction belt 140*a*, 140*b*, 140*c*, 140*d* against the guide beams 111*a*, 111*b*, as shown in FIG. 7. Then rotation of the motorized wheels 134*a*, 134*c* create a force F parallel to the guide beams 111*a*, 111*b*, which allows the traction belt 140*a*, 140*b*, 140*c*, 140*d* to climb up 21 or down 22 the guide beam 111*a*, 111*b*, as shown in FIG. 6. In an embodiment, the traction belt 140*a*, 140*b*, 140*c*, 140*d* may be composed of a flexible magnetic sheet 142 as illustrated in FIG. 7. In another embodiment, the traction belt 140*a*, 140*b*, 140*c*, 140*d* may be composed of a backing belt 144 and coated magnets 146 as illustrated in FIG. 8.

The guide beam extends vertically through the elevator shaft 117. It is understood that while two guide beams 111*a*, 111*b* are illustrated, the embodiments disclosed herein may be utilized with one or more guide beams. It is also understood that while two electric motors 132*a*, 132*c* are visible, the embodiments disclosed herein may be applicable to beam climber systems 130 having one or more electric motors. For example, the beam climber system 130 may have one electric motor for each wheel 134*a*, 134*b*, 134*c*, 134*d*, 134*e*, 134*f*, 134*g*, 134*h*. The electrical motors 132*a*, 132*c* may be permanent magnet electrical motors, asynchronous motor, or any electrical motor known to one of skill in the art.

Figure 5:
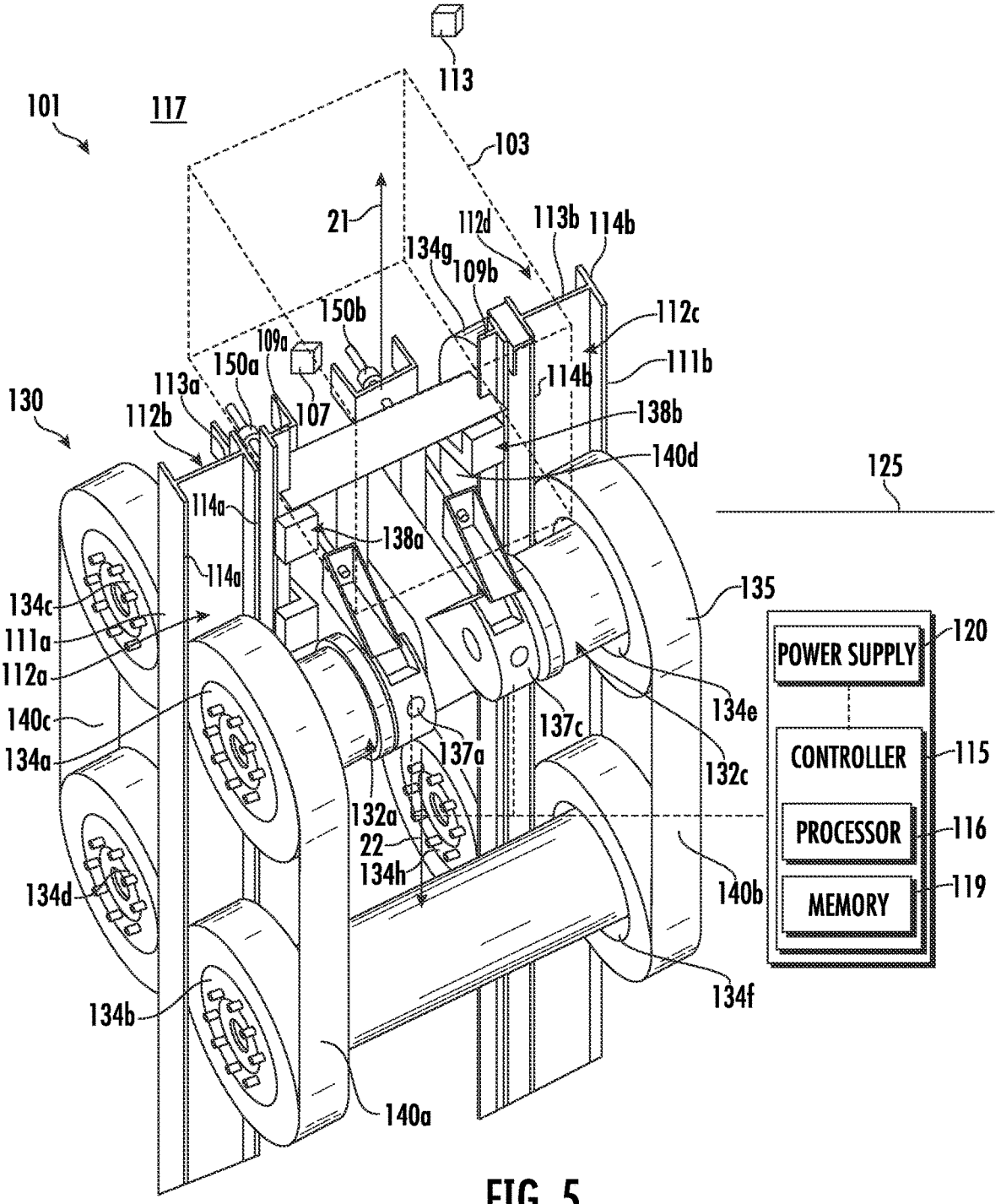
FIG. 5 is a schematic illustration of an elevator system with a beam climber system, in accordance with an embodiment of the disclosure.

The beam climber system 130 may include eight wheels 134*a*, 134*b*, 134*c*, 134*d*, 134*e*, 134*f*, 134*g*, 134*h*, which includes a first wheel 134*a*, a third wheel 134*c*, a fifth wheel 134*e*, a seventh wheel 134*g*, a second wheel 134*b*, a fourth wheel 134*d*, a sixth wheel 134*f*, and an eighth wheel 134*h*. As illustrated in FIG. 5, the first traction belt 140*a* may extend between and wrap around the first wheel 134*a* and the second wheel 134*b*. The first traction belt 140*a* rotates around the first wheel 134*a* and the second wheel 134*b*. The rotation of the first wheel 134*a* causes the first traction belt 140*a* to rotate, which causes the second wheel 134*b* to rotate. As illustrated in FIG. 5, the second traction belt 140*b* may extend between and wrap around the fifth wheel 134*e* and the sixth wheel 134*f*. The second traction belt 140*b* rotates around the fifth wheel 134*e* and the sixth wheel 134*f*

The rotation of the fifth wheel 134*e* causes the second traction belt 140*b* to rotate, which causes the sixth wheel 134*f* to rotate.

As illustrated in FIG. 5, the third traction belt 140*c* may extend between and wrap around the third wheel 134*c* and the fourth wheel 134*d*. The third traction belt 140*c* rotates around the third wheel 134*c* and the fourth wheel 134*d*. As illustrated in FIG. 5, the fourth traction belt 140*d* may extend between and wrap around the seventh wheel 134*g* and the eighth wheel 134*h*. The fourth traction belt 140*d* rotates around the seventh wheel 134*g* and the eighth wheel 134*h*.

In the embodiment illustrated in FIG. 5, the third wheel 134*c*, seventh wheel 134*g*, fourth wheel 134*d*, and eighth wheel 134*h* may act as idler wheels and be free to rotate with the movement of the other wheels 134*a*, 134*b*, 134*e*, 134*f*.

The third wheel 134*c* may be located opposite the first wheel 134, the fourth wheel 134*d* may be located opposite the second wheel 134*b*, the seventh wheel 134*g* may be located opposite the fifth wheel 134*e*, and the eighth wheel 134*h* may be located opposite the sixth wheel 134*f*.

The first guide beam 111*a* includes a web portion 113*a* and two flange portions 114*a*. The web portion 113*a* of the first guide beam 111*a* includes a first surface 112*a* and a second surface 112*b* opposite the first surface 112*a*. The first wheel 134*a* and the second wheel 134*b* are in contact with the first surface 112*a* through the first traction belt 140*a* and a third wheel 134*c* and the fourth wheel 134*d* may each be in contact with the second surface 112*b* through the third traction belt 140*c*, in accordance with the embodiment illustrated in FIG. 5. The first wheel 134*a* and the second wheel 134*b* are compressed against the first surface 112*a* of the first guide beam 111*a* by a first compression mechanism 150*a* and the third wheel 134*c* and the fourth wheel 134*d* are compressed against the second surface 112*b* of the first guide beam 111*a* by the first compression mechanism 150*a*. The first compression mechanism 150*a* compresses the first wheel 134*a* and the third wheel 134*c* together to clamp onto the web portion 113*a* of the first guide beam 111*a*. The first compression mechanism 150*a* may be a metallic or elastomeric spring mechanism, a pneumatic mechanism, a hydraulic mechanism, a turnbuckle mechanism, an electromechanical actuator mechanism, a spring system, a hydraulic cylinder, a motorized spring setup, or any other known force actuation method. The first compression mechanism 150*a* may be adjustable in real-time during operation of the elevator system 101 to control compression of the first wheel 134*a* and the third wheel 134*c* on the first guide beam 111*a*.

The first surface 112*a* and the second surface 112*b* extend vertically through the shaft 117, thus creating a track for the first traction belt 140*a* and the third traction belt 140*c* to ride on. The flange portions 114*a* may work as guardrails to help guide the first traction belt 140*a* and the third traction belt 140*c* along this track and thus help prevent the first traction belt 140*a* and the third traction belt 140*c* from running off track.

The first electric motor 132*a* is configured to rotate the first wheel 134*a*, which rotates the first traction belt 140*a* to climb up 21 or down 22 the first guide beam 111*a*. The first electric motor 132*a* may also include a first motor brake 137*a* to slow and stop rotation of the first electric motor 132*a*. The first motor brake 137*a* may be mechanically connected to the first electric motor 132*a*. The first motor brake 137*a* may be a clutch system, a disc brake system, a drum brake system, a brake on a rotor of the first electric motor 132*a*, an electronic braking, an Eddy current brakes, a Magnetorheological fluid brake or any other known braking system. The beam climber system 130 may also include a first guide rail brake 138*a* operably connected to the first guide rail 109*a*. The first guide rail brake 138*a* is configured to slow movement of the beam climber system 130 by clamping onto the first guide rail 109*a*. The first guide rail brake 138*a* may be a caliper brake acting on the first guide rail 109*a* on the beam climber system 130, or caliper brakes acting on the first guide rail 109*a* proximate the elevator car 103.

The second guide beam 111*b* includes a web portion 113*b* and two flange portions 114*b*. The web portion 113*b* of the second guide beam 111*b* includes a first surface 112*c* and a second surface 112*d* opposite the first surface 112*c*. A fifth wheel 134*e* and a sixth wheel 134*f* are in contact with the first surface 112*c* through the second traction belt 140*b* and a seventh wheel 134*g* and eighth wheel 134*h* may each be in contact with the second surface 112*d* the fourth traction belt 140*d*. A fifth wheel 134*e* is compressed against the first surface 112*c* of the second guide beam 111*b* by a second compression mechanism 150*b* and a seventh wheel 134*g* is compressed against the second surface 112*d* of the second guide beam 111*b* by the second compression mechanism 150*b*. The second compression mechanism 150*b* compresses the fifth wheel 134*e* and the seventh wheel 134*g* together to clamp onto the web portion 113*b* of the second guide beam 111*b*. The second compression mechanism 150*b* may be a spring mechanism, turnbuckle mechanism, an actuator mechanism, a spring system, a hydraulic cylinder, and/or a motorized spring setup. The second compression mechanism 150*b* may be adjustable in real-time during operation of the elevator system 101 to control compression of the fifth wheel 134*e* and the seventh wheel 134*g* on the second guide beam 111*b*.

The first surface 112*c* and the second surface 112*d* extend vertically through the shaft 117, thus creating a track for the second traction belt 140*b* and the fourth traction belt 140*d* to ride on. The flange portions 114*b* may work as guardrails to help guide the second traction belt 140*b* and the fourth traction belt 140*d* along this track and thus help prevent the second traction belt 140*b* and the fourth traction belt 140*d* from running off track.

The second electric motor 132*c* is configured to rotate the fifth wheel 134*e*, which rotates the second traction belt 140*b* to climb up 21 or down 22 the second guide beam 111*b*. The second electric motor 132*c* may also include a third motor brake 137*c* to slow and stop rotation of the third motor 132*c*. The third motor brake 137*c* may be mechanically connected to the third motor 132*c*. The third motor brake 137*c* may be a clutch system, a disc brake system, drum brake system, a brake on a rotor of the second electric motor 132*c*, an electronic braking, an Eddy current brake, a Magnetorheological fluid brake, or any other known braking system. The beam climber system 130 includes a second guide rail brake 138*b* operably connected to the second guide rail 109*b*. The second guide rail brake 138*b* is configured to slow movement of the beam climber system 130 by clamping onto the second guide rail 109*b*. The second guide rail brake 138*b* may be a caliper brake acting on the first guide rail 109*a* on the beam climber system 130, or caliper brakes acting on the first guide rail 109*a* proximate the elevator car 103.

The elevator system 101 may also include a position reference system 113. The position reference system 113 may be mounted on a fixed part at the top of the elevator shaft 117, such as on a support or guide rail 109, and may be configured to provide position signals related to a position of the elevator car 103 within the elevator shaft 117. In other embodiments, the position reference system 113 may be directly mounted to a moving component of the elevator system (e.g., the elevator car 103 or the beam climber system 130), or may be located in other positions and/or configurations as known in the art. The position reference system 113 can be any device or mechanism for monitoring a position of an elevator car within the elevator shaft 117, as known in the art. For example, without limitation, the position reference system 113 can be an encoder, sensor, accelerometer, altimeter, pressure sensor, range finder, or other system and can include velocity sensing, absolute position sensing, etc., as will be appreciated by those of skill in the art.

The controller 115 may be an electronic controller including a processor 116 and an associated memory 119 comprising computer-executable instructions that, when executed by the processor 116, cause the processor 116 to perform various operations. The processor 116 may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 119 may be but is not limited to a random access memory (RAM), read only memory (ROM), or other electronic, optical, magnetic or any other computer readable medium.

The controller 115 is configured to control the operation of the elevator car 103 and the beam climber system 130. For example, the controller 115 may provide drive signals to the beam climber system 130 to control the acceleration, deceleration, leveling, stopping, etc. of the elevator car 103.

The controller 115 may also be configured to receive position signals from the position reference system 113 or any other desired position reference device.

When moving up 21 or down 22 within the elevator shaft 117 along the guide rails 109*a*, 109*b*, the elevator car 103 may stop at one or more landings 125 as controlled by the controller 115. In one embodiment, the controller 115 may be located remotely or in the cloud. In another embodiment, the controller 115 may be located on the beam climber system 130. In embodiment, the controller 115 controls on-board motion control of the beam climber system 130 (e.g., a supervisory function above the individual motor controllers).

The power supply 120 for the elevator system 101 may be any power supply, including a power grid and/or battery power which, in combination with other components, is supplied to the beam climber system 130. In one embodiment, power supply 120 may be located on the beam climber system 130. In an embodiment, the power supply 120 is a battery that is included in the beam climber system 130.

The elevator system 101 may also include an accelerometer 107 attached to the elevator car 103 or the beam climber system 130. The accelerometer 107 is configured to detect an acceleration and/or a speed of the elevator car 103 and the beam climber system 130.

Figure 9:
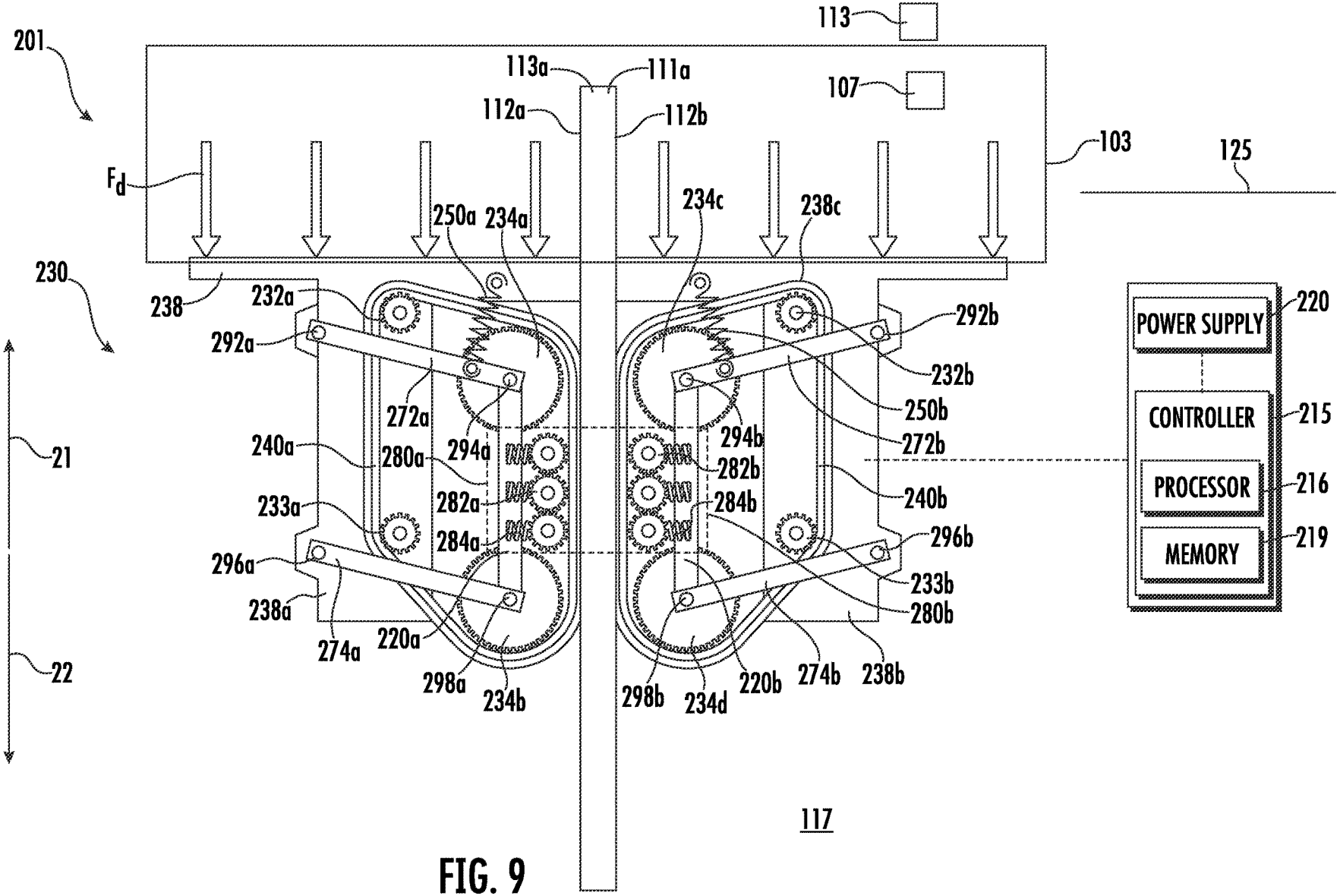
FIG. 9 is a schematic illustration of an elevator system with a beam climber system, in accordance with an embodiment of the disclosure.

FIG. 9 is a side view of an elevator system 201 including an elevator car 103, a beam climber system 230, a controller 215, and a power supply 220. Although illustrated in FIG. 9 as separate from the beam climber system 230, the embodiments described herein may be applicable to a controller 215 included in the beam climber system 230 (i.e., moving through an elevator shaft 117 with the beam climber system 230) and may also be applicable to a controller located off of the beam climber system 230 (i.e., remotely connected to the beam climber system 230 and stationary relative to the beam climber system 230). Although illustrated in FIG. 9 as separate from the beam climber system 230, the embodiments described herein may be applicable to a power supply 220 included in the beam climber system 230 (i.e., moving through the elevator shaft 117 with the beam climber system 230) and may also be applicable to a power supply located off of the beam climber system 230 (i.e., remotely connected to the beam climber system 230 and stationary relative to the beam climber system 230).

The beam climber system 230 is configured to move the elevator car 103 within the elevator shaft 117. The beam climber system 230 includes one or more motors 232*a*, 232*c*. The motors 232*a*, 232*b*, 233*a*, 233*b* are configured to move the beam climber system 230 within the elevator shaft 117 by rotating one or more wheels 234*a*, 234*b*, which rotate traction belts 240*a*, 240*b* that are pressed against a guide beam 111*a*, 111*b*. In an embodiment, the guide beams 111*a*, 111*b* are I-beams. It is understood that while an I-beam is illustrated, any beam or similar structure may be utilized with the embodiment described herein. The traction belts 240*a*, 240*b* may be a toothed timing belt or a traditional flat belt, such as, for example, a coated steel belt. The coated steel belt may achieve traction via contact pressure and a coefficient of friction.

The guide beam extends vertically through the elevator shaft 117. It is understood that while one guide beams 111*a* is illustrated, the embodiments disclosed herein may be utilized with one or more guide beams. It is also understood that while four motors 232*a*, 233*a*, 232*b*, 233*b* are illustrated visible, the embodiments disclosed herein may be applicable to beam climber systems 230 having two or more motors. The motors 232*a*, 233*a*, 232*b*, 233*b* may be permanent magnet electrical motors, asynchronous motor, or any electrical motor known to one of skill in the art. In other embodiments, not illustrated herein, another configuration could have the powered wheels at two different vertical locations (i.e., at bottom and top of an elevator car 103).

The beam climber system 320 may include four wheels 234*a*, 234*b*, 234*c*, 234*d*, which includes a first wheel 234*a*, a second wheel 234*b*, a third wheel 234*c*, and a fourth wheel 234*d*. As illustrated in FIG. 9, the first traction belt 240*a* may extend around the first wheel 234*a*, the second wheel 234*b*, the first motor 232*a*, and the second motor 233*a*. The first traction belt 240*a* rotates around the first wheel 234*a*, the second wheel 234*b*, the first motor 232*a*, and the second motor 233*a*. The rotation of the first motor 232*a* and/or the second motor 233*a* causes the first traction belt 240*a* to rotate, which then rotates the first wheel 234*a* and the second wheel 234*b*. In an embodiment, the second motor 233*a* may be replaced by an idler and be free to rotate with the movement of the first wheel 234*a*.

As illustrated in FIG. 9, the second traction belt 240*b* may extend around the third wheel 234*c*, the fourth wheel 234*d*, the third motor 232*b*, and the fourth motor 233*b*. The second traction belt 240*b* rotates around the third wheel 234*c*, the fourth wheel 234*d*, the third motor 232*b*, and the fourth motor 233*b*. The rotation of the third motor 232*b* and/or the fourth motor 232*c* causes the second traction belt 240*b* to rotate, which then rotates the third wheel 234*c* and the fourth wheel 234*d*. In an embodiment, the fourth motor 233*b* may be replaced by an idler and be free to rotate with the movement of the third wheel 234*c*.

The first guide beam 111*a* includes a web portion 113*a* and two flange portions (not shown for simplicity). The web portion 113*a* of the first guide beam 111*a* includes a first surface 112*a* and a second surface 112*b* opposite the first surface 112*a*. The first wheel 134*a* and the second wheel 134*b* are in contact with the first surface 112*a* through the first traction belt 240*a*. The third wheel 234*c* and the fourth wheel 134*d* are in contact with the second surface 112*b* through the second traction belt 240*b*.

The beam climber system 230 a structural support frame 238. The structural support frame 238 includes a first vertical component 238*a*, a second vertical component 238*b*, and a horizontal component 238*c* connecting the first vertical 238*a* and second vertical component 238*b*. The first vertical component 238*a* and the second vertical component 238*b* may be oriented about parallel to the first guide beam 111*a*. The horizontal component 238*c* may be oriented about perpendicular to the first guide beam 111*a*.

The first wheel 234*a* and the second wheel 234*b* are located between the first vertical component 238*a* and the first guide beam 111*a*. The third wheel 234*c* and the fourth wheel 234*d* are located between the second vertical component 238*b* and the first guide beam 111*a*.

The first wheel 234*a* and the second wheel 234*b* are compressed against the first surface 112*a* of the first guide beam 111*a* by a downward force $F_d$ when going downward 22 and when going upward 21. The downward force $F_d$ is generated by the weight of the elevator car 103 and the beam climber system 230. The first spring 250*a* extends from a first pivot arm 272*a* to the horizontal component 238*c*. The first spring 250*a* is configured to maintain contact in an event of a rapid deceleration while ascending.

The first wheel 234*a* is operably attached to the first vertical component 238*a* of a structural support frame 238 of the beam climber system 230 through the first pivot arm 272*a*. The first pivot arm 272*a* is operably attached to the first vertical component 238*a* of the structural support frame 238 at a first pivot point 292*a*. Pivot points may be defined herein as rotatable connection points, pivot axles, or hinge points between two or more components. The first pivot arm 272*a* may rotate or pivot around the first pivot point 292*a*. The first pivot arm 272*a* is operably attached to the first wheel 234*a* at a second pivot point 294*a*. The first pivot arm 272*a* may rotate or pivot around the second pivot point 294*a*. The first wheel 234*a* may rotate around the second pivot point 294*a*.

The second wheel 234*b* is operably attached to the first vertical component 238*a* of the structural support frame 238 of the beam climber system 230 through a second pivot arm 274*a*. The second pivot arm 274*a* is operably attached to the first vertical component 238*a* at a third pivot point 296*a*. The second pivot arm 274*a* may rotate or pivot around the third pivot point 296*a*. The second pivot arm 274*a* is operably attached to the second wheel 234*b* at a fourth pivot point 298*a*. The second pivot arm 274*a* may rotate or pivot around the fourth pivot point 298*a*. The second wheel 234*b* may rotate around the fourth pivot point 298*a*.

The first wheel 234*a* and the second wheel 234*b* may be operably connected to a third pivot arm 220*a*. The third pivot arm 220*a* is operably connected to the first wheel 234*a* at the second pivot point 294*a*. The third pivot arm 220*a* may rotate or pivot around the second pivot point 294*a*. The third pivot arm 220*a* is operably connected to the second wheel 234*b* at the fourth pivot point 298*a*. The third pivot arm 220*a* may rotate or pivot around the fourth pivot point 298*a*.

The beam climber system 230 may also include a first biasing assembly 280*a* to further compress the first traction belt 240*a*. The first biasing assembly 280*a* may be operably attached to the third pivot arm 220*a*. The first biasing assembly 280*a* may include one or more first roller wheels 282*a* (i.e., sprocket) and each of the one or more first roller wheels 282*a* may be operably attached to the third pivot arm 220*a* through a first biasing mechanism 284*a*. The first biasing mechanism 284*a* is configured to press the first roller wheel 282*a* against the first traction belt 240*a*, which is pressed against the first surface 112*a* of the first guide beam 111*a*. The first biasing mechanism 284*a* may be a spring. Alternatively, the first biasing mechanism 284*a* and the first roller wheels 282*a* may be replaced by a low friction material (e.g., sliding guide) that pushes the first traction belt 240*a* into the beam. The third wheel 234*c* and the fourth wheel 234*d* are compressed against the second surface 112*b* of the first guide beam 111*a* by the downward force $F_d$ when going downward 22 and when going upward 21. The downward force $F_d$ is generated by the weight of the elevator car 103 and the beam climber system 230. The second spring 250*b* extends from a fourth pivot arm 272*b* to the horizontal component 238*c*. The second spring 250*b* is configured to maintain contact in an event of a rapid deceleration while ascending.

The third wheel 234*c* is operably attached to the second vertical component 238*b* of the structural support frame 238 of the beam climber system 230 through a fourth pivot arm 272*b*. The fourth pivot arm 272*b* is operably attached to the second vertical component 238*b* at a fifth pivot point 292*b*. The fourth pivot arm 272*b* may rotate or pivot around the fifth pivot point 292*b*. The fourth pivot arm 272*b* is operably attached to the third wheel 234*c* at a sixth pivot point 294*b*. The fourth pivot arm 272*b* may rotate or pivot around the sixth pivot point 294*b*. The third wheel 234*c* may rotate around the sixth pivot point 294*b*.

The fourth wheel 234*d* is operably attached to the second vertical component 238*b* of the structural support frame 238 of the beam climber system 230 through a fifth pivot arm 274*b*. The fifth pivot arm 274*b* is operably attached to the second vertical component 238*b* at a seventh pivot point 296*b*. The fifth pivot arm 274*b* may rotate or pivot around the seventh pivot point 296*b*. The fifth pivot arm 274*b* is operably attached to the fourth wheel 234*d* at an eighth pivot point 298*b*. The fifth pivot arm 274*b* may rotate or pivot around the eighth pivot point 298*b*. The fourth wheel 234*d* may rotate around the eighth pivot point 298*b*.

The third wheel 234*c* and the fourth wheel 234*d* may be operably connected to a sixth pivot arm 220*b*. The sixth pivot arm 220*b* is operably connected to the third wheel 234*c* at the sixth pivot point 294*b*. The sixth pivot arm 220*b* may rotate or pivot around the sixth pivot point 294*b*. The sixth pivot arm 220*b* is operably connected to the fourth wheel 234*d* at the eighth pivot point 298*b*. The sixth pivot arm 220*b* may rotate or pivot around the eighth pivot point 298*b*.

The beam climber system 230 may also include a second biasing assembly 280*b* to further compress the first traction belt 240*a*. The second biasing assembly 280*b* may be operably attached to the sixth pivot arm 220*b*. The second biasing assembly 280*b* may include one or more second roller wheels 282*b* and each of the one or more second roller wheels 282*b* may be operably attached to the sixth pivot arm 220*b* through a second biasing mechanism 284*b*. The second biasing mechanism 284*b* is configured to press the second roller wheel 282*b* against the second traction belt 240*b*, which is pressed against the second surface 112*b* of the first guide beam 111*a*. The second biasing mechanism 284*b* may be a spring. Alternatively, the second biasing mechanism 284*b* and the second roller wheels 282*b* may be replaced by a low friction material (e.g., sliding guide) that pushes the first traction belt 240*a* into the beam.

The first surface 112*a* extends vertically through the shaft 117, thus creating a track for the first traction belt 240*a* to ride on. The second surface 112*b* extends vertically through the shaft 117, thus creating a track for the second traction belt 240*b* to ride on.

The first motor 232*a*, the second motor 233*a*, the third motor 232*b*, and the fourth motor 233*b* may be electrical motors may be permanent magnet electrical motors, asynchronous motor, or any electrical motor known to one of skill in the art.

The first motor 232*a* and/or the second motor 233*a* are configured to rotate the first the first traction belt 240*a* to climb up 21 or down 22 the first guide beam 111*a*. The first wheel 234*a* and the second wheel 234*b* also rotate when the first traction belt 240*a* rotates. The first motor 232*a* and the second motor 233*a* may also include a motor brake (not shown for simplicity) to slow and stop rotation of the first traction belt 240*a*. The motor brake of the first motor 232*a* may be mechanically connected to the first motor 232*a* and the motor brake of the second motor 233*a* may be mechanically connected to the second motor 233*a*. The motor brake may be a clutch system, a disc brake system, a drum brake system, a brake on a rotor of the first electric motor, an electronic braking, an Eddy current brakes, a Magnetorheological fluid brake or any other known braking system.

The third motor 232*b* and/or the fourth motor 233*b* are configured to rotate the first the second traction belt 240*b* to climb up 21 or down 22 the first guide beam 111*a*. The third wheel 234*c* and the fourth wheel 234*d* also rotate when the second traction belt 240*b* rotates. The third motor 232*b* and the fourth motor 233*b* may also include a motor brake (not shown for simplicity) to slow and stop rotation of the second traction belt 240*b*. The motor brake of the third motor 232*b* may be mechanically connected to the third motor 232*b* and the motor brake of the fourth motor 233*b* may be mechanically connected to the fourth motor 233*b*. The motor brake may be a clutch system, a disc brake system, a drum brake system, a brake on a rotor of the first electric motor, an electronic braking, an Eddy current brakes, a Magnetorheological fluid brake or any other known braking system.

The elevator system 201 may also include a position reference system 113. The position reference system 113 may be mounted on a fixed part at the top of the elevator shaft 117, such as on a support, the first guide beam 111*a*, or any guide rail, and may be configured to provide position signals related to a position of the elevator car 103 within the elevator shaft 117. In other embodiments, the position reference system 113 may be directly mounted to a moving component of the elevator system 201 (e.g., the elevator car 103 or the beam climber system 230), or may be located in other positions and/or configurations as known in the art. The position reference system 113 can be any device or mechanism for monitoring a position of an elevator car within the elevator shaft 117, as known in the art. For example, without limitation, the position reference system 113 can be an encoder, sensor, accelerometer, altimeter, pressure sensor, range finder, or other system and can include velocity sensing, absolute position sensing, etc., as will be appreciated by those of skill in the art.

The controller 215 may be an electronic controller including a processor 216 and an associated memory 219 comprising computer-executable instructions that, when executed by the processor 216, cause the processor 216 to perform various operations. The processor 216 may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 219 may be but is not limited to a random access memory (RAM), read only memory (ROM), or other electronic, optical, magnetic or any other computer readable medium.

The controller 215 is configured to control the operation of the elevator car 103 and the beam climber system 230. For example, the controller 215 may provide drive signals to the beam climber system 230 to control the acceleration, deceleration, leveling, stopping, etc. of the elevator car 103.

The controller 215 may also be configured to receive position signals from the position reference system 113 or any other desired position reference device.

When moving up 21 or down 22 within the elevator shaft 117, the elevator car 103 may stop at one or more landings 125 as controlled by the controller 215. In one embodiment, the controller 215 may be located remotely or in the cloud. In another embodiment, the controller 215 may be located on the beam climber system 230. In embodiment, the controller 215 controls on-board motion control of the beam climber system 230 (e.g., a supervisory function above the individual motor controllers).

The power supply 220 for the elevator system 201 may be any power supply, including a power grid and/or battery power which, in combination with other components, is supplied to the beam climber system 230. In one embodiment, power supply 220 may be located on the beam climber system 230. In an embodiment, the power supply 220 is a battery that is included in the beam climber system 230.

The elevator system 201 may also include an accelerometer 107 attached to the elevator car 103 or the beam climber system 230. The accelerometer 107 is configured to detect an acceleration and/or a speed of the elevator car 103 and the beam climber system 230.

The present invention may be a system, a method, and/or a computer program product at any possible technical detail level of integration. The computer program product may include a computer readable storage medium (or media) having computer readable program instructions thereon for causing a processor to carry out aspects of the present invention.

As described above, embodiments can be in the form of processor-implemented processes and devices for practicing those processes, such as processor. Embodiments can also be in the form of computer program code (e.g., computer program product) containing instructions embodied in tangible media (e.g., non-transitory computer readable medium), such as floppy diskettes, CD ROMs, hard drives, or any other non-transitory computer readable medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an device for practicing the exemplary embodiments. When implemented on a general-purpose microprocessor, the computer program code segments configure the microprocessor to create specific logic circuits.

The term "about" is intended to include the degree of error associated with measurement of the particular quantity and/ or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the claims.

What is claimed is:

1. An elevator system, the elevator system comprising:

a beam climber system configured to move an elevator car through an elevator shaft by climbing a first guide beam that extends vertically through the elevator shaft, the first guide beam comprising a first surface and a second surface opposite the first surface, the beam climber system comprising:

a first wheel;

a second wheel;

a first traction belt wrapped around the first wheel and the second wheel, the first traction belt being in contact with the first surface;

a first electric motor configured to rotate the first wheel, wherein the first traction belt is configured to rotate when the first wheel rotates;

a third wheel disposed at the second surface; and a compression mechanism connecting the first wheel and the third wheel, the compression mechanism configured to compress the first wheel into the first surface and compress the third wheel into the second surface.

2. The elevator system of claim 1, wherein the first traction belt is configured to climb up or down the first guide beam when rotated.

3. The elevator system of claim 1, wherein the third wheel is located opposite the first wheel.

4. The elevator system of claim 1, further comprising: a second guide beam that extends vertically through the elevator shaft, the second guide beam comprising a first surface of the second guide beam and a second surface of the second guide beam opposite the first surface of the second guide beam, wherein the beam climber system further comprises:

a third wheel;

a fourth wheel;

a second traction belt wrapped around the third wheel and the fourth wheel, the second traction belt being in contact with the first surface of the second guide beam and being magnetically attracted to the second guide beam;

a second electric motor configured to rotate the third wheel, wherein the second traction belt is configured to rotate when the third wheel rotates.

5. The elevator system of claim 4, wherein the second traction belt is configured to climb up or down the second guide beam when rotated.

6. An elevator system, the elevator system comprising:

a beam climber system configured to move an elevator car through an elevator shaft by climbing a first guide beam that extends vertically through the elevator shaft, the first guide beam comprising a first surface and a second surface opposite the first surface, the beam climber system comprising:

a first wheel;

a second wheel;

a first traction belt wrapped around the first wheel and the second wheel, the first traction belt being in contact with the first surface;

a first electric motor configured to rotate the first wheel, wherein the first traction belt is configured to rotate when the first wheel rotates;

a third wheel disposed at the second surface; and a compression mechanism connecting the first wheel and the third wheel, the compression mechanism configured to urge the third wheel toward the first wheel;

wherein the first traction belt is magnetically attracted to the first guide beam.

7. The elevator system of claim 6, wherein the first traction belt is composed of a flexible magnetic sheet.

8. The elevator system of claim 6, wherein the first traction belt is composed of a backing belt and coated magnets.

9. The elevator system of claim 6, wherein the first traction belt is magnetized.

10. An elevator system, the elevator system comprising: a beam climber system configured to move an elevator car through an elevator shaft by climbing a first guide beam that extends vertically through the elevator shaft, the first guide beam comprising a first surface and a second surface opposite the first surface, the beam climber system comprising:

a first wheel;

a second wheel;

a first motor configured to rotate the first wheel;

a first traction belt wrapped around the first wheel, the second wheel, and the first motor, the first traction belt being in contact with the first surface, wherein the first traction belt, the first wheel, and the second wheel are configured to rotate when the first motor rotates;

a third wheel disposed at the second surface; and a compression mechanism connecting the first wheel and the third wheel, the compression mechanism configured to compress the first wheel into the first surface and compress the third wheel into the second surface.

11. The elevator system of claim 10, wherein the first traction belt is configured to climb up or down the first guide beam when rotated.

12. The elevator system of claim 10, wherein the first traction belt is a toothed timing belt.

13. The elevator system of claim 10, wherein the first traction belt is a traditional flat belt.

14. The elevator system of claim 10, wherein the beam climber system further comprises a structural support frame, the structural support frame comprising a first vertical component, a second vertical component, and a horizontal component connecting the first vertical component and the second vertical component.

15. The elevator system of claim 14, wherein the beam climber system further comprises a first pivot arm, wherein the first wheel is operably attached to the first vertical component through the first pivot arm.

16. The elevator system of claim 15, wherein the beam climber system further comprises a second pivot arm, wherein the second wheel is operably attached to the first vertical component through the second pivot arm.

17. The elevator system of claim 15, wherein the beam climber system further comprises a first spring extending between the first pivot arm to the horizontal component.

18. The elevator system of claim 16, wherein the beam climber system further comprises a third pivot arm, wherein the first wheel and the second wheel are operably connected to the third pivot arm.

19. The elevator system of claim 18, wherein the beam climber system further comprising a first biasing assembly operably attached to the third pivot arm, the first biasing assembly configured to press the first roller wheel against the first traction belt, which is pressed against the first surface of the first guide beam.

* * * * *